US011945623B2

(12) United States Patent
Emanuel et al.

(10) Patent No.: US 11,945,623 B2
(45) Date of Patent: Apr. 2, 2024

(54) FOLDABLE MULTI-PURPOSE CONTAINER FILLER

(71) Applicant: Hallmark Cards, Incorporated, Kansas City, MO (US)

(72) Inventors: Mary Hund Emanuel, Kansas City, MO (US); Lai Pui Betty Ko, Hong Kong (HK); Wing Ki Li, Hong Kong (HK); Fung Yee Wai, Hong Kong (HK)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 53 days.

(21) Appl. No.: 17/230,674

(22) Filed: Apr. 14, 2021

(65) Prior Publication Data

US 2022/0332470 A1 Oct. 20, 2022

(51) Int. Cl.
*B65D 33/00* (2006.01)
*B65D 5/44* (2006.01)

(52) U.S. Cl.
CPC ..... *B65D 33/004* (2013.01); *B65D 5/44* (2013.01)

(58) Field of Classification Search
CPC ..... B65D 33/004; B65D 5/44
USPC ..... 206/459.5, 457, 461–471, 806; 40/124.13
See application file for complete search history.

(56) References Cited

U.S. PATENT DOCUMENTS

| | | | | | |
|---|---|---|---|---|---|
| 3,933,245 | A * | 1/1976 | Mullen | B65D 75/58 | 206/532 |
| 4,867,577 | A * | 9/1989 | Cheng | D04D 7/10 | 229/922 |
| 4,917,291 | A * | 4/1990 | Saiki | B65D 75/14 | 229/922 |
| 5,234,727 | A * | 8/1993 | Hoberman | A63H 33/16 | 428/542.2 |
| 6,146,018 | A * | 11/2000 | Keller | B65D 33/004 | 229/125.32 |
| 9,630,748 | B2 * | 4/2017 | Keller | B65D 33/16 | |
| 10,081,456 | B2 * | 9/2018 | Wagner | B65D 33/004 | |
| 2012/0033897 | A1 * | 2/2012 | Lahr Yoder | B65D 85/00 | 383/6 |
| 2016/0264303 | A1 * | 9/2016 | Borges | B65D 33/004 | |

* cited by examiner

*Primary Examiner* — J. Gregory Pickett
*Assistant Examiner* — Jenine Pagan
(74) *Attorney, Agent, or Firm* — STINSON LLP

(57) ABSTRACT

A foldable multi-purpose container filler includes a sheet of material that may be reversibly convertible between a compact form for storage or packaging and an expanded form to fill a container opening (e.g., bag, drinkware, vase, etc.). The container filler includes fold lines or creases that dictate the compact form and the expanded form and allow for reversible conversion between the forms. In addition, the container filler includes connectors for securing the container filler to a container, as well as a base to support the container filler upright on a surface absent a container.

16 Claims, 5 Drawing Sheets

FOLDABLE MULTI-PURPOSE CONTAINER FILLER

BACKGROUND

Open-ended containers, such as bags (e.g., gift bags), drinkware (e.g., mugs), vases, etc., commonly contribute to a gift experience and/or event decorations. These containers may be used in various manners and, in some instances, fill material may be arranged in the open end of the container. For example, conventional fill material includes tissue paper, which may be folded or crinkled from an initial flat state and then stuffed inside the open end of the container to conceal a gift therein or the inside of a mug to create a gift and/or decoration. However, tissue paper is susceptible to sliding down inside the container, or falling out of the container, and may be difficult and/or time consuming to arrange (e.g., by trial-and-error) in an aesthetically pleasing manner. In addition, tissue paper is typically used a limited number of times (e.g., once) based on its tear susceptibility and/or crinkle or crumple creases, which reduce aesthetics for subsequent uses. Moreover, the crumpling, crinkling, and folding applied to tissue paper for one container often does not usually carry over for a desired arrangement in a subsequent container, further making the tissue paper single use. In addition, tissue paper may present storage challenges after being converted from an initial flat state into a more expanded form, which may occupy more space and/or be harder to store neatly in an organized manner.

SUMMARY

This summary provides an overview of some subject matter of this disclosure and introduces a selection of concepts further described below in the detailed-description section. This summary is not intended to identify key features or essential features of the claimed subject matter, nor is it intended to be used as an aid in isolation to determine the scope of the claimed subject matter.

Embodiments of the present disclosure relate to a foldable multi-purpose container filler. Articles and methods are disclosed including a sheet of material (e.g., paper or cardstock) that may be reversibly convertible between a compact form for storage or packaging and an expanded form to fill a container opening. In aspects, the conversion may be controlled by pre-determined fold lines or creases that dictate the compact form and the expanded form and allow for reversible conversion between the forms. Because the conversion and expanded form may be pre-determined by the fold lines or creases (e.g., prior to a consumer purchasing the bag filler), arranging the container filler may be faster, more efficient, and more easily accomplished than conventional approaches by reducing some of the trial-and-error guesswork typically experienced by a consumer. In addition, because the container filler of the present disclosure may be reversibly convertible between forms, the container filler may be easily reduced back to a compact state after use for storage and subsequent use. Moreover, the expanded state may be more universally usable than conventional tissue paper, which may reduce the likelihood that folds or creases will reduce usability in subsequent use contexts.

In a further aspect, the container filler may include connectors attachable to sides of the container, and the connectors may reduce the likelihood of the filler inadvertently sliding down into the container or dislodging from the container. Further still, the container filler may be usable in other applications. For example, the container filler may include a base that is self-supporting and that permits the container filler to sit upright on a surface, such as for decoration, signage, advertising, and the like.

The present disclosure also includes a method of making a container filler by executing a series of folds permitting the container filler to reversibly convert between a compact form and an expanded form.

BRIEF DESCRIPTION OF THE DRAWINGS

A foldable multi-purpose container filler is described in detail below with reference to the figures that are submitted together with this written specification and that are briefly described in this section. Each figure is incorporated by reference in its entirety, and the disclosure provided by each figure, both implicitly and explicitly, is intended to be included in this specification.

DETAILED DESCRIPTION

Figure 1:
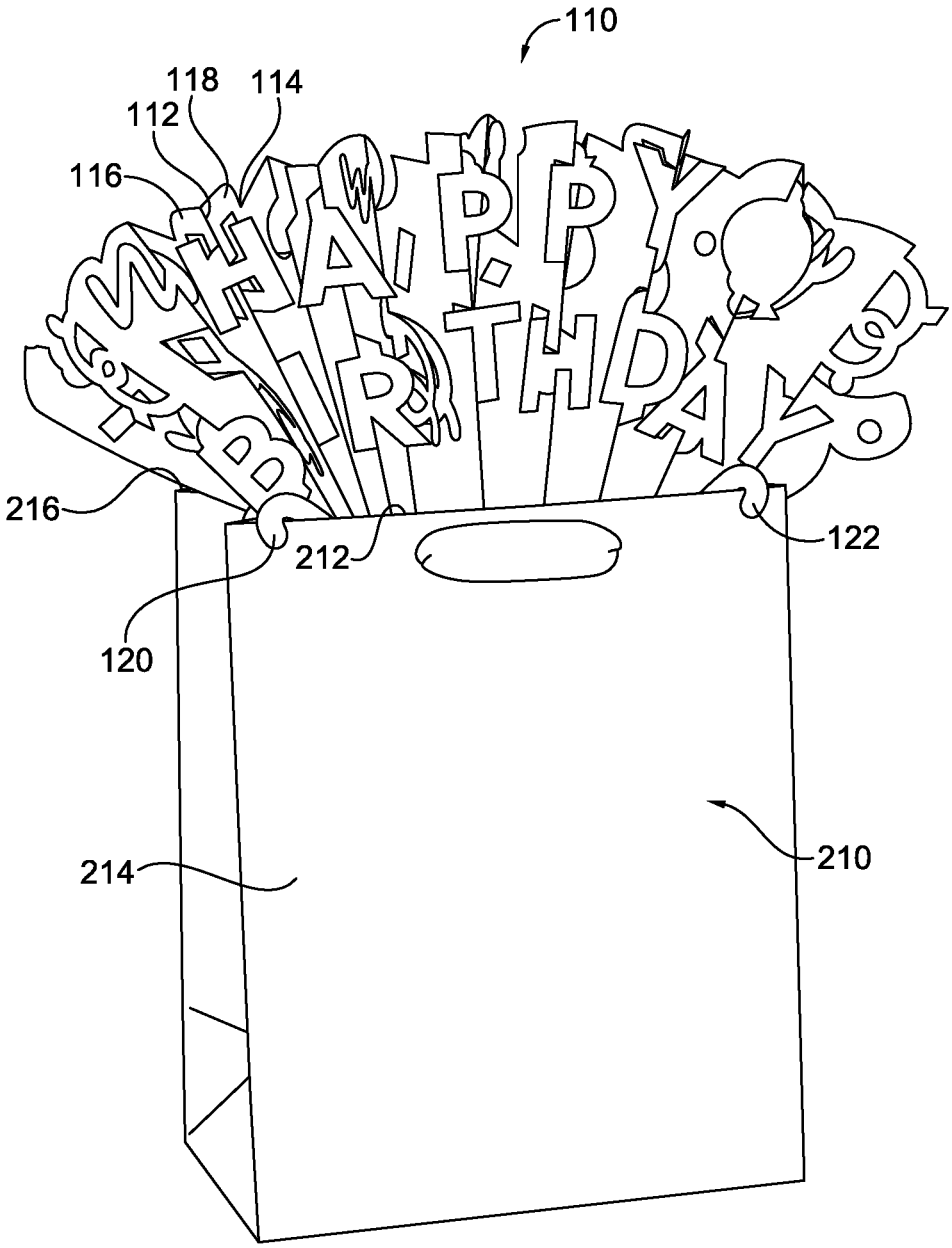
FIG. 1 is a front perspective view of a foldable multi-purpose container filler positioned in an opening of a container in accordance with an embodiment of the present disclosure.

The subject matter described in this Specification generally relates to, among other things, a foldable multi-purpose container filler. Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present technologies or future technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

In some aspects, a container filler may include a sheet of material (e.g., paper or cardstock) reversibly convertible between a compact form for storage or packaging and an expanded form to fill a container opening or to provide a decoration. For example, the compact form may be a flat sheet or a compressed, unexpanded form that is conducive to packaging or storage (e.g., shrink wrapped to a hanging backer for retail display) in a neat and/or organized manner. Further, the expanded form may include various folds and angled faces or panels that add dimensionality and volume, which may be useful to fill the container opening or create a self-supporting base. In aspects, the conversion between the compact form and the expanded form is controlled by pre-determined fold lines or creases that dictate the compact form and the expanded form and allow for reversible conversion between the forms. The fold lines may include indicia marked (e.g., inked) on a surface of a flat sheet or may include actual crease lines to instruct (e.g., indicate to a consumer) where folds or creases should be placed. Because the conversion and expanded form, in some embodiments, is pre-determined by the fold lines or creases (e.g., prior to a consumer purchasing the bag filler), arranging the container filler may be faster, more efficient, and more easily accomplished than conventional approaches by reducing some of the trial-and-error guesswork typically experienced by a consumer. In addition, the container filler of the present disclosure may be usable to fill an opening in various types of containers, such as a bag (e.g., gift bag), drinkware (e.g., mug), vase, and the like.

In further aspects, the folds or creases of the container filler create panels, segments, and/or faces that can be arranged in different positions relative to one another by changing an extent to which a fold is opened or closed. These variable positions of the panels may comprise the overall state of the container filler and contribute to whether the container filler is in a more compact form or a more expanded form, thereby allowing it to fill the opening of containers of varying sizes. For example, a fold may be transitioned to a more closed state in order to draw panels closer to one another in a more nested relationship (e.g., face-to-face) to fill a smaller bag. Alternatively, folds may be opened to bias panels away from one another and more spread out to expand the container filler to fill a larger bag. Because the container filler of the present disclosure is reversibly convertible between forms by opening or closing folds, the container filler can be easily transformed back to a compact state after use for storage and subsequent use.

In a further aspect, the container filler may include connectors (e.g., hooks) attachable to sides of a container (e.g., gift bag, mug, vase, etc.). Examples of connectors include hooks that may frictionally engage an upper periphery of the container near the container opening. Among other things, the connectors may reduce the likelihood of the filler inadvertently sliding down into the container or dislodging from the container. In addition, the hooks may be integrally formed with other parts of the container filler (e.g., die-cut), which may allow the hooks to blend in with other portions of the container filler, contribute to the overall aesthetic of the container filler, and not detract from use of the container filler when not concealing the opening of a container.

Further still, the container filler may be usable in other applications. For example, the container filler may include a base that is self-supporting and that permits the container filler to stand upright on a surface. As such, the container filler may be used in other applications, such as for decoration, table topper, signage, advertising, and the like.

Referring now to the accompanying figures, FIGS. 1-6 depict one possible embodiment of a container filler of the present invention. The illustrated embodiment will now be discussed in detail, but specific features thereof, whether illustrated or described, need not be in all embodiments of the present invention. Turning now to FIG. 1, a container filler 110 is positioned inside a container 210. In the illustrated embodiment the container 210 is a gift bag having a first wall segment 214 and a second wall segment 216 that at least partially enclose a volume there between into which the container filler 110 is partially positioned through an opening to the volume adjacent the top of the container 210. In general, the container filler 110 includes a sheet of material, such as paper, cardstock, or fiberboard, having various folds (e.g., 112 and 114) that form panels (e.g., 116 and 118), and the folds may be adjusted (e.g., by opening or closing) to transform the container filler 110 between a more compact form and a more expanded form to fit containers of varying sizes. In FIG. 1, the container filler 110 has been partially expanded and positioned in an opening of the container 210 to at least partially fill the opening. Among other things, the container filler 110 may conceal an item (e.g., a gift or purchased item) in the container 210 and form a decorative element.

The container filler 110 also includes connectors 120 and 122, which may releasably attach to the container 210. For example, the connectors 120 and 122 may take the form of hooks that frictionally engage a top edge or upper periphery 212 of the container 210. The connectors 120 and 122 reduce a likelihood that the container filler 110 inadvertently slips down into the container or otherwise dislodges from the container 210.

FIG. 1 depicts the container 210 as a bag. In other aspects of this disclosure, the container 210 may include other types of containers having different sizes and different shaped volumes. For example, the container 210 may be drinkware or a vase or another container. In addition, the volume of the container may be more square or cube-shaped or cylindrical or have some other shape, depending on a configuration of the wall segments.

Figure 2:
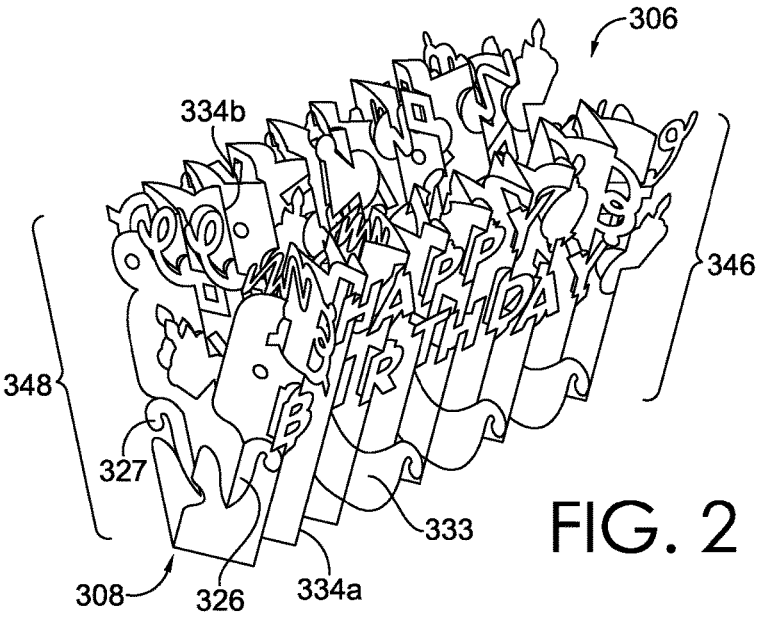
FIG. 2 is a perspective view of the foldable multi-purpose container filler of FIG. 1 without being positioned in a container.

Referring to FIG. 2, FIG. 2 depicts another view of a container filler 306 not positioned in the container 210. In an aspect of the disclosure, the container filler 306 includes a base 308 that connects the various panels and folds (e.g., 334*a* and 334*b*) together as a unit. The container filler 306 includes a first sheet portion 346 and a second sheet portion 348 that are coupled to one another by the base 308. The first sheet portion 346 includes a connector 326 to attach to a wall segment of a container, and the second sheet portion 348 also includes a connector 327 (other potential connectors being hidden from view) that may also be used to attach to a wall segment of the container. In one aspect, the first sheet portion 346 and the second sheet portion 348 are hingedly coupled to one another at the base 308, such as along a fold line, and the first sheet portion 346 and the second sheet portion 348 may hingedly open or close at the base 308 to adjust a size of the container filler 306 (e.g., to fit openings of varying sizes or to compress for storage). In addition, the base 308 may be self-supporting, such that with the base 308, the container filler 306 may sit upright on a surface (e.g., table top) without assistance from other structures (e.g., tape, adhesive, a stand, etc.) and without attaching to a container. In an aspect of the disclosure, the connectors 326 and 327 are integral with the container filler 306 and aesthetically blend, still providing a desired aesthetic, even when the connectors 326 and 327 are not being used to attach to a container.

In one aspect of the disclosure, the container filler 306 is constructed from a single material sheet (e.g., paper, cardstock, fiberboard, etc.), which is reversibly convertible between a compact form for storage or packaging and an expanded form to fill a container opening or to provide a decoration. The compact form may be a flat sheet or a compressed, unexpanded form that is conducive to packaging or storage (e.g., in a storage or retail bag, a drawer, or box) in a neat and/or organized manner. For example, referring to FIG. 3, FIG. 3 depicts one example of an unexpanded form including a foldable sheet of material 310, which may be transformed (e.g., by folding) to comprise the more expanded version of the container filler 306.

Figure 3:
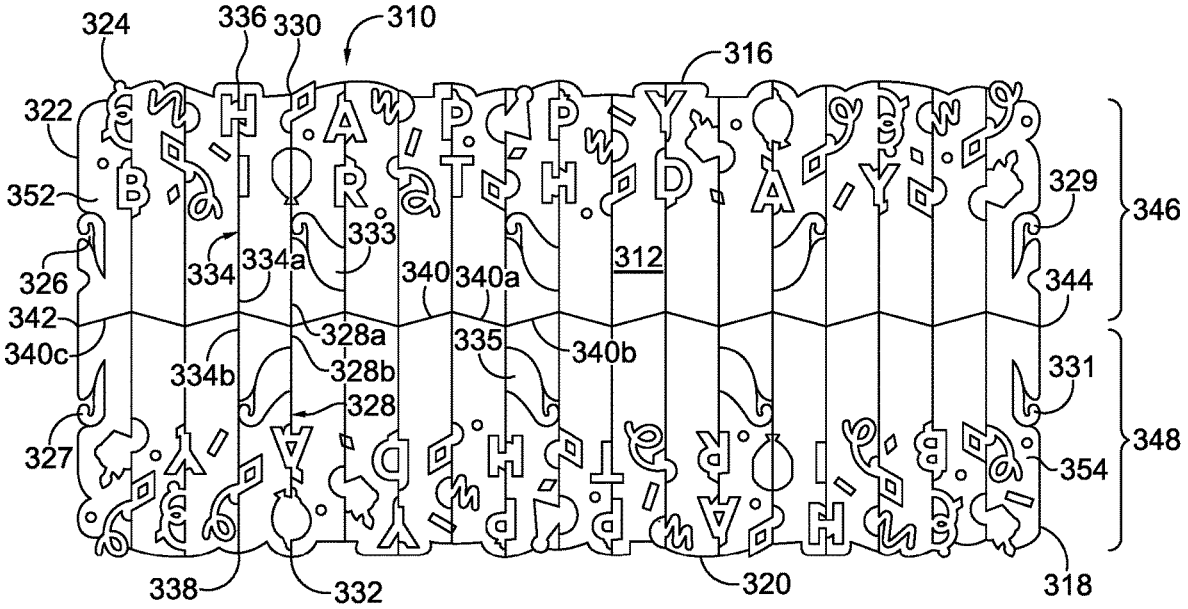
FIG. 3 is a top plan view of the foldable multi-purpose container filler of FIG. 1 in an initial flat configuration prior to being folded into the shape depicted in FIG. 2.
Figure 4:
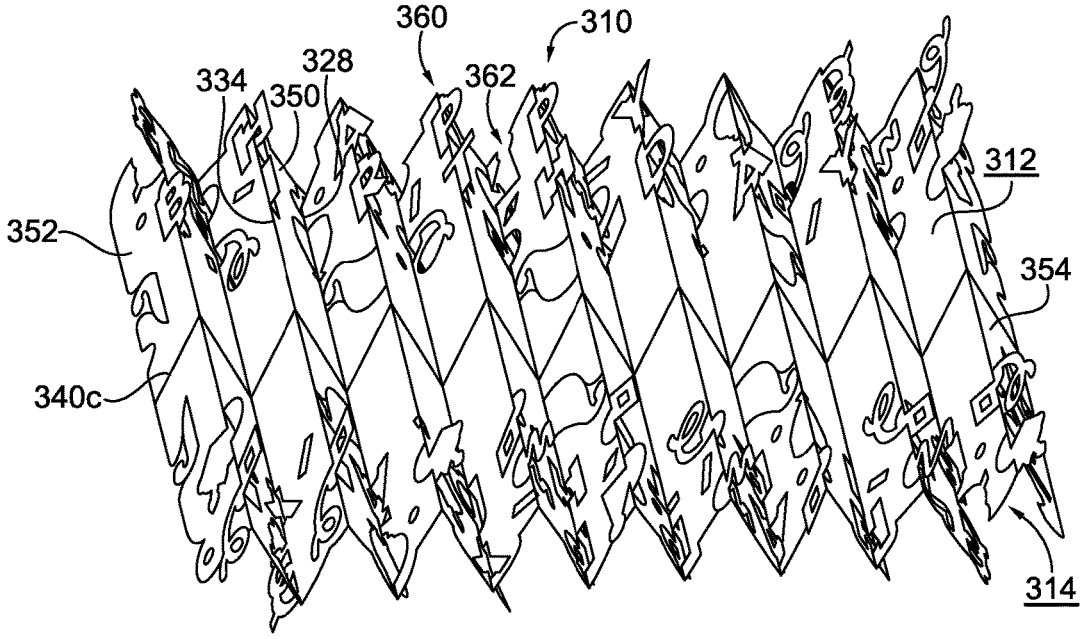
FIG. 4 is a perspective view of the foldable multi-purpose container filler of FIG. 3 folded into a partially accordion folded configuration.

In FIG. 3, the sheet 310 includes a first face 312 and a second face 314, which is on the opposing side as the first face 312 and is obscured from view in FIG. 3 (see FIG. 4 with reference numeral 314 identifying the face on the opposite side of the sheet as the first face 312). In addition, the foldable sheet includes a circumscribing perimeter edge 316, 318, 320, and 322 that terminates an extent of the foldable sheet 310. In FIG. 3, the sheet 310 generally includes a rectangular shape, based on the path of the perimeter edge 316, 318, 320, and 322, and in other aspects the shape could alternatively be a variety of other two-dimensional forms (e.g., square, ovular, hexagonal, etc.). In addition, the perimeter edge 316, 318, 320, and 322 includes various path fluctuations 324 and 326, which may contribute to the aesthetic of the container filler 306 (e.g., a scalloped edge) or may form some other structural element, such as a connector (e.g., 120 or 122). The container filler 306 may be formed by various techniques, such as by cutting (e.g. die-cutting, laser cutting, etc.) the foldable sheet 310 from a material blank. In that regard, FIG. 3 can represent a plan view of an unfolded container filler 306 die-cut from a blank of paper or card stock sheet material. Some of the straight lines represent where folds or creases are to be formed. Some of the curved lines represent die-cut lines and some of the curved lines represent indicia printed on the upper surface or first face 312.

In addition, the sheet 310 includes one or more fold lines to transform the sheet 310 to a more compact form or arrangement. A fold line may include an indicia marked on a face of the sheet, such as by ink (e.g., printed onto the surface) or by a groove (e.g., debossed into the surface). For example, the sheet 310 includes a first fold line 328 extending across the sheet 310 and between opposing points 330 and 332 of the perimeter edge 316, 318, 320, and 322. In addition, the sheet 310 includes a second fold line 334 extending across the sheet 310 and between opposing points 336 and 338 of the perimeter edge 316, 318, 320, and 322. In some instances, the fold lines 328 and 334 may be aligned in a same orientation (e.g., parallel) to one another. In addition, the fold lines 328 and 334, when folded, may form a panel or wall of the container filler 306. As depicted in FIG. 3, the sheet 310 may include several additional fold lines aligned in a similar orientation with the first fold line 328 and the second fold line 334, each of the additional fold lines extending between respective opposing points on the perimeter 316, 318, 320, and 322 and being foldable to form additional panels that are all connected or linked together.

In one aspect of the present disclosure, the sheet 310 may be accordion folded along the fold lines 328 and 334 (and along the other fold lines extending parallel thereto), and as such, these fold lines may be referred to in this disclosure as "accordion fold lines." Accordion folding refers to alternatingly folding the sheet 310 back and forth between first face 312 to second face 314 and second face 314 to first face 312 along the fold lines.

In a further aspect, the sheet 310 may include another fold line 340 that intersects the first fold line 328 and the second fold line 334 and that extends across the sheet 310 between opposing points 342 and 344 of the perimeter edge 316, 318, 320, and 322. In one aspect of the disclosure, the fold line 340 divides the sheet 310 into a first sheet portion 346 and a second sheet portion 348. The first sheet portion 346 and the second sheet portion 348 may be mostly congruent or similarly sized, such that the fold line 340 generally bisects the sheet 310. Alternatively, the first sheet portion 346 and the second sheet portion 348 may be discongruent in size, such that the fold line 340 divides the sheet 310 into portions but does not necessarily bisect the sheet 310 into congruently sized portions. As such, the fold line 340 may be referred to in this disclosure as a "dividing fold line" since it divides the sheet 310 into the first sheet portion 346 and the second sheet portion 348, and may also be referred to in this disclosure as a "bisecting fold line" when the first sheet portion 346 and the second sheet portion 348 are substantially congruent in size.

In addition, the fold line 340 may divide each of the other fold lines 328 and 334 that intersects with the fold line 340 into a first fold-line segment and a second fold-line segment. For example, the fold line 328 includes fold-line segment 328*a* extending from the fold line 340 to the point 330 and a fold-line segment 328*b* extending from the fold line 340 to the point 332, and the fold line 334 includes a fold-line segment 334*a* extending from the fold line 340 to the point 336 and a fold-line segment 334*b* extending from the fold line 340 to the point 338.

The fold line 340 may include various line shapes or paths. For example, in the illustrated embodiment, the fold line 340 includes a series of V-shapes or chevrons aligned end to end. In a further aspect, the point of each V-shape or chevron may point in the same direction and align with every other accordion fold line intersecting the line 340. Stated differently, the fold line 340 may alternate at each accordion fold line between a first orientation and a second orientation in a flat plane of the sheet 310. For example, fold-line segment 340*a* includes the fold line 340 extending in a first orientation in a plane of the sheet 310 and fold-line segment 340*b* includes the fold line 340 extending in a second orientation in the plane of the sheet 310. Described in yet another manner, the fold line 340 may alternatingly zig-zag at each accordion fold line.

In an alternative aspect, the dividing fold line may include other line shapes or paths not depicted in the drawings. For example, the dividing fold line may be straight between opposing points 342 and 344. Alternatively, the angle of the V-shapes or chevrons or orientations may be more acute or more obtuse. In another aspect, the angle formed at one or more of the accordion fold lines may vary across the sheet 310. Further still, the panels formed by the accordion fold lines may be different sizes, such that the segments (e.g., 340*a* and 340*b*) of the dividing fold line 340 have varied lengths.

As mentioned, the sheet 310 includes a connector 326, and may also include a plurality of other connectors 327, 329, and 331. The connectors 326, 327, 329, and 331 may be integrally formed from or with the sheet 310 and may be hooks for frictionally engaging a portion of a container (e.g., a top edge of a container wall segment or the upper periphery of the sidewalls that defines the opening into the volume of the container). For example, the connectors 326, 327, 329, and 331 may be made from the same material as the sheet and may include a connector base that extends continuously from the sheet, such as results with the connector is cut (e.g., die cut) from a sheet blank. A connector may be positioned relative to the dividing fold line 340, such as a set distance between the connector (e.g., hook throat) and the dividing fold line 340. In one aspect of the disclosure, the distance between the hook throat of one connector 326 and the dividing fold line 340 is the same as the distance between the hook throat of another connector 372 and the dividing fold line 340, both connectors 326 and 372 being on the same sheet portion 346. In one example, distances may be measured from corresponding points on each connector (e.g., from the mouth) and along a reference line extending parallel to the accordion fold lines. Among other things, this common distance may help support the container filler at a target height relative to a container, and the target height may be configured to display a decoration or message (e.g., "Happy Birthday" in a desired manner, as depicted in FIG. 1) relative to the container. The connectors 326, 327, 329 and 331 are positioned along the perimeter edge (e.g., they form part of the perimeter edge). In a further aspect, the sheet 310 may include additional connectors 333 and 335 that are positioned interior of the sheet 310 along fold lines (e.g., the connector base is positioned long a fold line), such that when a fold is applied to the fold line, the connector can be made to pop out from the plane of the sheet 310 to provide additional connection points along the interior of the container filler 306 that can engage with the upper periphery of the bag so the middle of the container filler doesn't sag down into the container when the container filler 306 is use on large or wide containers.

Figure 5:
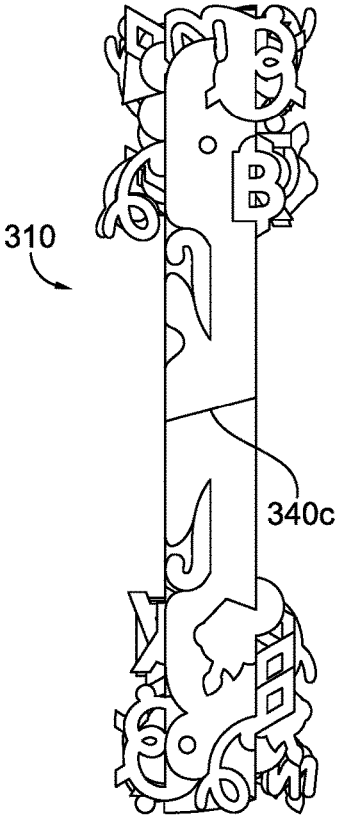
FIG. 5 is a left side elevation view of the foldable multi-purpose container filler of FIG. 4 folded into a compressed accordion-folded configuration.
Figure 6:
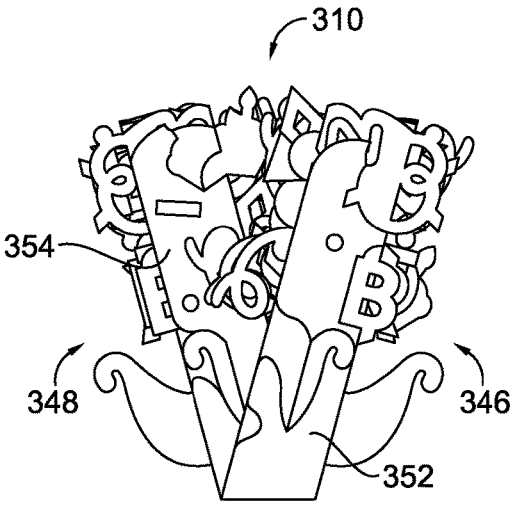
FIG. 6 is a left side elevation view of the foldable multi-purpose container filler of FIG. 5 after being folded in half at an angle to provide the configuration depicted in FIG. 2.
Figure 7:
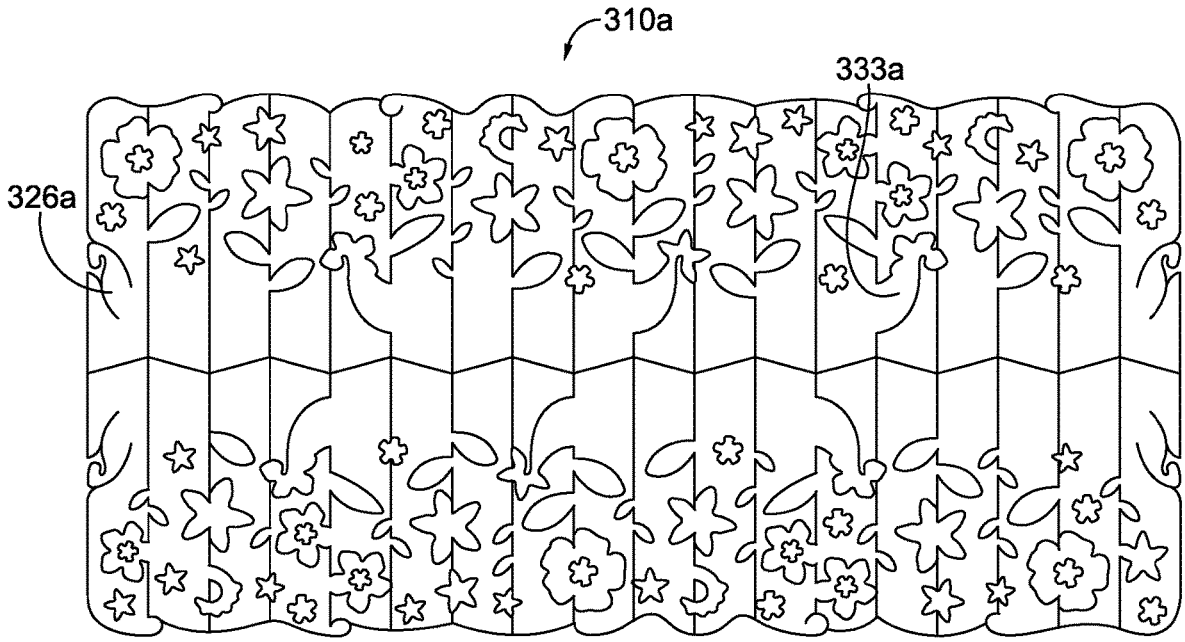
FIGS. 7-10 illustrate top plan views of alternate designs of the foldable multi-purpose container filler of the present invention with similar features as those disclosed in FIGS. 1-6.
Figure 8:
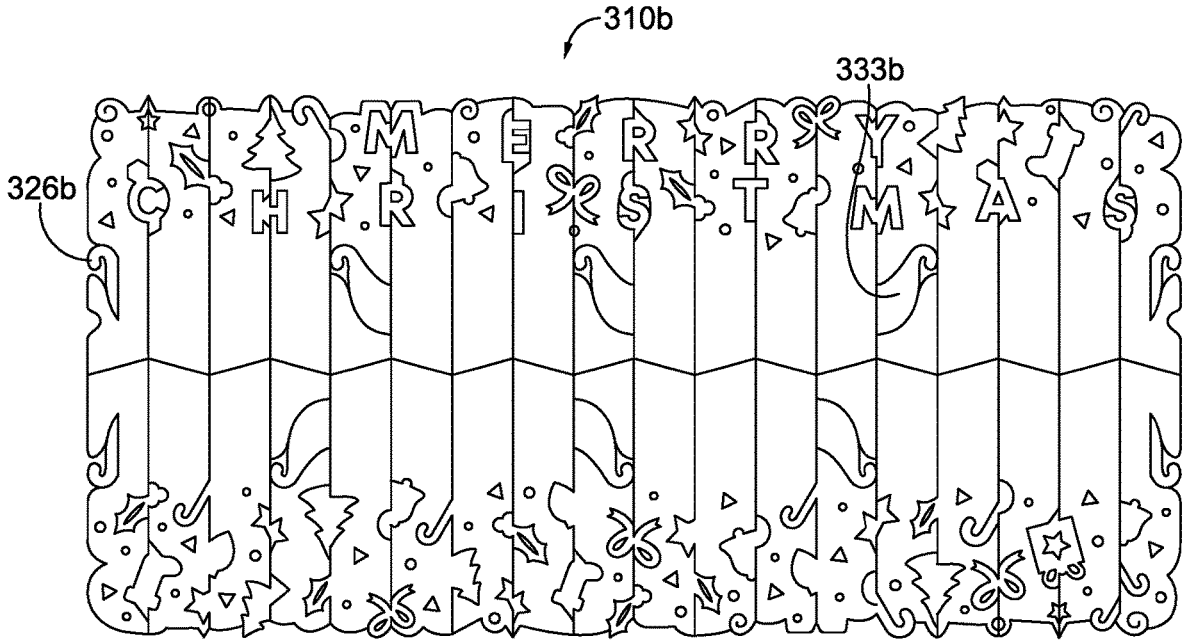
Figure 9:
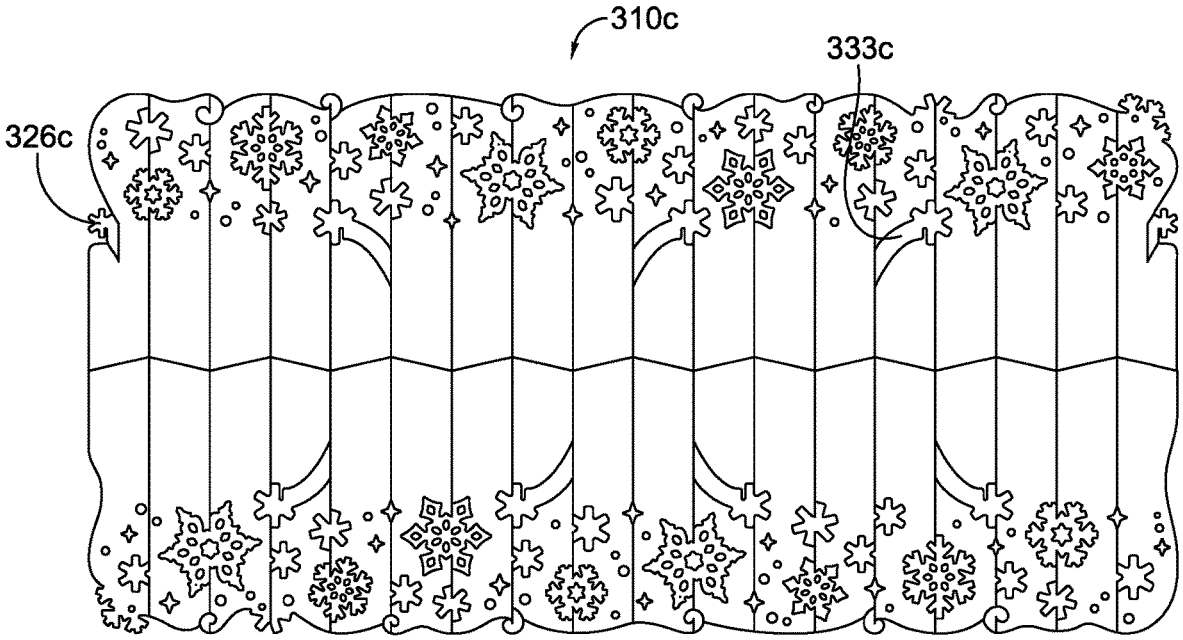
Figure 10:
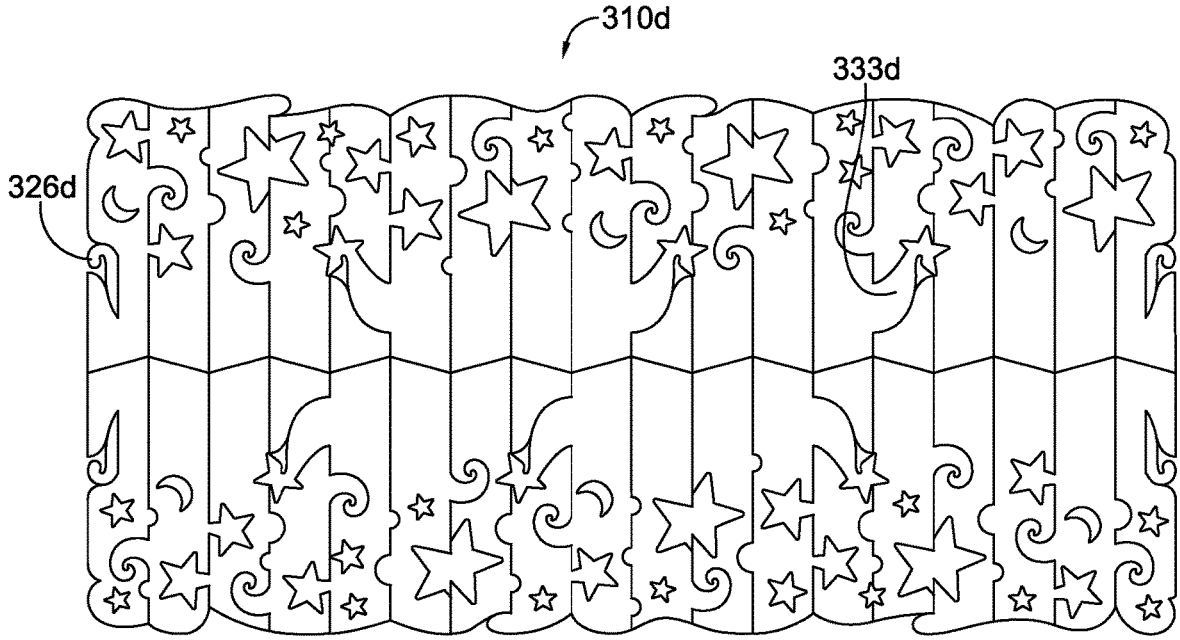

Having described the sheet 310 in a flat arrangement, reference is now also made to FIGS. 4, 5, and 6 to describe a transformation of the sheet 310 to the container filler 306 when folds are applied to the fold lines. FIG. 4 depicts the sheet 310 partially transformed by accordion folds having been applied to each of the accordion fold lines (e.g., 328 and 334), and the accordion folds form a series of linked panels (e.g., 350). With the accordion folds applied, the sheet 310 includes a series of alternating peaks (e.g., 360) and troughs (e.g., 362).

FIG. 5 depicts the sheet 310 having been further transformed from the state depicted in FIG. 4, by more fully closing the folds (e.g., 328 and 334) to draw the panels and faces closer together in a more compressed, stacked arrangement. In addition, FIG. 5 depicts a fold-line segment 340*c* of the dividing fold line 340 (also identified in FIGS. 3 and 4).

FIG. 6 depicts the sheet 310 having been further transformed by applying a fold to the fold-line segment 340*c*, which provides a crease along which the sheet 310 may be divided into the first sheet portion 346 having a first set of accordion folded panels and the second sheet portion 348 having a second set of accordion folded panels. In FIG. 6, the accordion folded panels of the first sheet portion 346 include a first end panel 352, which is also depicted in FIGS. 3 and 4 for reference. In the configuration depicted in FIG. 6, all of the other accordion folded panels of the first sheet portion 346 are stacked directly behind the first end panel 352. FIG. 6 also depicts a second end panel 354 of the second sheet portion 348, which is also depicted in FIGS. 3 and 4, and all of the other accordion folded panels of the second sheet portion 348 are stacked directly behind the second end panel 354. This is accomplished by virtue of the dividing fold line 340 having a series of V-shapes or chevrons, which offsets or angles the portions of each accordion fold away from each other.

In an aspect of the disclosure, in order to transform the sheet 310 from the state depicted in FIG. 6 to the state depicted in FIG. 2 at least some of the folds are reversed. That is, in the state represented in FIG. 6, some of the folds bias portions of the sheet 310 first face 312 to first face 312 and at least some of those folds may be reversed to instead position the sheet 310 second face 314 to second face 314. In addition, some of the folds bias portions of the sheet 310 second face 314 to second face 314 and at least some of those folds may be reversed to instead position the sheet 310 first face 312 to first face 312.

For example, in one aspect of the disclosure to transform the sheet 310 from the state in FIG. 6 to the state in FIG. 2, every other fold-line segment of the dividing line 340 may be manipulated to change a direction, and as a result, every fold-line segment of the dividing fold line 340 may bias the sheet 310 in the same orientation, either first face 312 to first face 312 or second face 314 to second face 314. With this additional transformation, the sheet 310 becomes bi-folded, as depicted in FIG. 2, with the dividing fold line 340 biasing the sheet 310 either first face 312 to first face 312 or second face 314 to second face 314. In a further aspect, each fold-line segment of the accordion fold lines of one of the sheet portions (e.g., either first sheet portion 346 or second sheet portion 348) may be reversed. For example, in FIG. 6, each accordion fold biases the sheet in the same manner along the entire accordion fold line from one opposing point of the perimeter to the other opposing point of the perimeter. As such, the entire accordion fold forms either a trough or a peak. In one aspect, each accordion fold-line segment (e.g., 328*b* and 334*b*) in one of the sheet portions (either 346 or 348) may be reversed, with a result being that along a single accordion fold (e.g., 328), the sheet 310 transitions at the intersection with the dividing fold line 340 from being folded in one direction (e.g., first face to first face) to being folded in the opposing direction (e.g., second face to second face). In addition, along a single accordion fold (e.g., 328), the sheet 310 transitions at the intersection with the dividing fold line 340 between a peak and a trough. For example, in FIG. 2 the folds 334*a* and 334*b* are along the same accordion fold line 334, are substantially co-planar, and the fold 334*a* forms a peak of the sheet portion 346, whereas the fold 334*b* forms a trough of the sheet portion 348.

Among other things, this fold arrangement in FIG. 2 may allow the end panels of the container filler 306 to be easily compressed and held in a compressed form while preserving the structure of the container filler 306 for subsequent use, either in filling an opening of a container or as a free standing decoration. In addition, the dimensionality provided by the multi-orientation dividing line provides a stable base 308 upon which the container filler 306 may sit, free-standing and self-supporting on a surface. In a further aspect, the connectors 326, 327, and 333 may be selectively partially released from the sheet, or folded outward from the sheet, to be positioned to attach to the top edge of a container wall segment. For example, the connector 333 (e.g., hook) includes a base (e.g., hook base) continuous with the sheet and positioned along a fold line forming a peak, such that the connector may be selectively released from the sheet for connection to a container edge.

Some aspects of this disclosure have been described with respect to the examples provided in the figures. Additional aspects of the disclosure will now be described that may be related subject matter included in one or more claims of this application at the time of filing (and may also be included in at least one example provided in the figures), and the claims are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

An aspect of the present disclosure includes an article. The article may include a container comprising a first wall segment and a second wall segment at least partially enclosing a volume. For example, the container 210 includes a first wall segment 214 and a second wall segment 216. In the illustrated embodiment the container 210 comprises a bag. In other embodiments, the container may include other forms, such as a drinkware, a vase, etc., having one or more wall segments at least partially enclosing a volume. The article also includes a bi-folded sheet to at least partially fill an opening to the volume, the bi-folded sheet comprising a fold line hingedly coupling a first sheet portion to a second sheet portion. For example, the container filler 110 or 306 includes a bi-folded sheet (e.g., the sheet 310) folded along the dividing fold line 340, which hingedly couples the sheet portion 346 to the sheet portion 348. The article further comprises a first one or more connectors coupled to the first sheet portion and to attach to the first wall segment, and a second one or more connectors coupled to the second sheet portion and to attach to the second wall segment. For example, the container fillers 110 and 306 include the connectors 120/122 and 326/327, respectively.

Another aspect of the disclosure includes an article comprising a foldable sheet comprising a first face, a second face, and a circumscribing perimeter edge. For example, the foldable sheet 310 (in FIGS. 3, 4, 5, and 6) includes a first face 312 and a second face 314 and a circumscribing perimeter edge 316, 318, 320, and 322. The article also comprises a first fold line extending across the foldable sheet between first opposing points of the perimeter edge, and a second fold line extending across the foldable sheet between second opposing points of the perimeter edge. For example, the sheet 310 includes a first fold line 328 extending across the sheet 310 between opposing points 330 and 332 and a second fold line 334 extending across the sheet 310 between opposing points 336 and 338. The article further includes a third fold line intersecting the first fold line and the second fold line and extending across the foldable sheet between third opposing points of the perimeter edge. The third fold line changes between a first orientation and a second orientation at a first intersection with the first fold line and at a second intersection with the second fold line. For example, the dividing fold line 340 intersects the fold lines 328 and 334 and extends across the sheet 310 between opposing points 342 and 344. In addition, the dividing fold line 340 includes segments (e.g., 340*a* and 340*b*) that change between orientations at intersections with the accordion fold lines. In addition, the article includes a hook coupled to the foldable sheet and open towards the third fold line. For example, the connector 326 (e.g., the hook) is coupled to the sheet 310 and opens towards the dividing fold line 340.

A further aspect is directed to a method. The method includes accordion folding a sheet to create alternating folds and multiple panels arranged in a stack of panels. For example, in FIGS. 4 and 5, the sheet 310 has been accordion folded to create a stack of panels. The method also includes forming a width-wise crease across the stack of panels, the crease extending non-perpendicularly to each fold of the alternating folds. The crease divides the sheet into a first sheet portion having a respective first segment of each fold of the alternating folds and a second sheet portion having a respective second segment of each fold of the alternating folds. For example, in FIG. 6, a crease has been formed along the fold line 340*c* and across a width direction of the elongated orientation of the stack. The crease divides the sheet 310 into a first sheet portion 346 and a second sheet portion 348, and each sheet portion includes a respective segment (e.g., 328*a*, 328*b*, 334*a*, and 334*b*) of each fold of the alternating folds (e.g., folds along 328 and 334). The method may further comprise unfolding the stack and reversing a fold direction of each respective second segment. For example, to transform the stack from the configuration in FIG. 6 to the configuration in FIG. 2, the stack of FIG. 6 may be unfolded, and each fold segment (e.g., 328*b* and 334*b*) in the sheet portion 348 may be reversed.

FIGS. 7-10 illustrate alternate embodiments of the foldable multi-purpose container filler of the present invention. As best compared with FIG. 3, these alternate embodiments have different designs or themes, but have similar functional features to those described above. For example, each of the sheets 310*a*-*d* still have interior connectors 333*a*-*d*, though of varying shapes. The connectors 333*a*-*d* still perform the same function as the connectors 333 discussed above with reference to FIGS. 1-6. The same is true for connectors 326*a*-*d*, which perform a similar function as connector 326, but have a different shape. Other features of varying shapes are illustrated in the alternate designs depicted in FIGS. 7-10, but which function similarly to those features illustrated in FIGS. 1-6.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

Many different arrangements of the various components depicted, as well as components not shown, are possible without departing from the scope of the claims below. Embodiments of this disclosure have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. An article comprising:

a bi-folded sheet to at least partially fill an opening of a container comprising a first wall segment and a second wall segment, the bi-folded sheet comprising a fold line hingedly coupling a first sheet portion to a second sheet portion;

a first one or more connectors coupled to the first sheet portion and configured to attach to the first wall segment; and a second one or more connectors coupled to the second sheet portion and configured to attach to the second wall segment;

wherein each connector of the first one or more connectors extends continuously from the first sheet portion and frictionally engages a top edge of the first wall segment, and wherein each connector of the second one or more connectors extends continuously from the second sheet portion and frictionally engages a top edge of the second wall segment.

2. The article of claim 1, wherein the first sheet portion is accordion folded and comprises a first set of alternating peaks and troughs and the second sheet portion is accordion folded and comprises a second set of alternating peaks and troughs, and wherein each peak of the first set is co-planar with a corresponding trough of the second set and each trough of the first set is co-planar with a corresponding peak in the second set.

3. The article of claim 1, wherein each connector of the first one or more connectors comprises a hook base continuous with the first sheet portion and a hook throat to engage a top edge of the first wall segment, and wherein each connector of the second one or more connectors comprises a hook base continuous with the second sheet portion and a hook throat to engage a top edge of the second wall segment.

4. The article of claim 1, wherein the first sheet portion includes a plurality of first folds that are co-planar with a plurality of second folds of the second sheet portion, and wherein the first folds and the second folds non-perpendicularly intersect with the fold line.

5. The article of claim 1, wherein the bi-folded sheet is configured to at least partially fill an opening of a container comprising a gift bag, a drinkware, or a vase.

6. The article of claim 1, wherein the bi-folded sheet is configured to be partially positioned within a volume enclosed by the first and second wall segments of the container when the first one or more connectors are attached to the first wall segment and the second one or more connectors are attached to the second wall segment.

7. The article of claim 6, wherein the fold line is configured to rest below the top edge of the first wall segment and the top edge of the second wall segment when the first one or more connectors engage the top edge of the first wall segment and the second one or more connectors engage the top edge of the second wall segment.

8. An article comprising:

a foldable sheet comprising a first face, a second face, and a circumscribing perimeter edge;

a first fold line extending across the foldable sheet between first opposing points of the perimeter edge;

a second fold line extending across the foldable sheet between second opposing points of the perimeter edge;

a third fold line intersecting the first fold line and the second fold line and extending across the foldable sheet between third opposing points of the perimeter edge;

a hook coupled to the foldable sheet, the hook spaced a distance from the third fold line and open towards the third fold line, the hook having a hook bend; and a second hook having a second hook bend and a third hook having a third hook bend, wherein the hook bend, the second hook bend, and the third hook bend are collinear.

9. The article of claim 8, wherein the first fold line and the second fold line are parallel to one another.

10. The article of claim 8, wherein the third fold line divides the foldable sheet into a first sheet portion comprising a first segment of the first fold line and a first segment of the second fold line and into a second sheet portion comprising a second segment of the first fold line and a second segment of the second fold line;

wherein the third fold line, the first segment of the first fold line, and the second segment of the second fold line are to fold the foldable sheet first face to first face; and wherein the second segment of the first fold line and the first segment of the second fold line are to fold the foldable sheet second face to second face.

11. The article of claim 8, wherein the first fold line includes a first fold-line segment to fold the foldable sheet first face to first face, and wherein the hook comprises a hook base continuous with the foldable sheet and positioned along the first fold-line segment.

12. The article of claim 8, wherein the hook is integral with the foldable sheet, extending continuously from the foldable sheet, and comprising a same material as the foldable sheet.

13. The article of claim 8, wherein the second hook is spaced a second distance from the third fold line, the distance being equal to the second distance.

14. The article of claim 8, wherein the hook and the second hook are positioned along the perimeter edge.

15. The article of claim 8, wherein the hook comprises a hook base extending continuously from the foldable sheet and a hook throat configured to engage a top edge of a container.

16. An article comprising:

a foldable sheet comprising a first face, a second face, and a circumscribing perimeter edge;

a first fold line extending across the foldable sheet between first opposing points of the perimeter edge;

a second fold line extending across the foldable sheet between second opposing points of the perimeter edge;

a third fold line intersecting the first fold line and the second fold line and extending across the foldable sheet between third opposing points of the perimeter edge;

a hook coupled to the foldable sheet, the hook spaced a distance from the third fold line and open towards the third fold line; and additional fold lines parallel with the first fold line and the second fold line and intersecting with the third fold line, wherein the third fold line changes between a first orientation and a second orientation at each intersection with each of the additional fold lines.

* * * * *